US005884859A

United States Patent [19]

Ma

[11] Patent Number: 5,884,859

[45] Date of Patent: Mar. 23, 1999

[54] COIL WINDER FOR USE IN LARGE UMBRELLAS

[76] Inventor: Mark Joen-Shen Ma, 12 Fl. 578 Kwang Fu S. Rd., Taipei, Taiwan

[21] Appl. No.: 937,342

[22] Filed: Sep. 20, 1997

Related U.S. Application Data

[60] Provisional application No. 60/037,440 Feb. 7, 1997.

[51] Int. Cl. [6] ..... A45B 17/00; B65H 75/34

[52] U.S. Cl. ..... 242/395; 242/396.6; 135/20.3

[58] Field of Search ..... 242/395, 395.1, 242/396.6, 396.5, 396.1, 306; 135/20.3, 25.1, 25.4, 25.41

[56] References Cited

U.S. PATENT DOCUMENTS

| | | | |
|---|---|---|---|
| 4,386,621 | 6/1983 | Redl | 135/20.3 |
| 4,548,367 | 10/1985 | Councilman | 242/306 |
| 4,619,281 | 10/1986 | Redl et al. | 135/20.3 |
| 5,297,757 | 3/1994 | Johansson et al. | 242/306 |
| 5,437,297 | 8/1995 | Crisman et al. | 135/20.2 |
| 5,711,333 | 1/1998 | Vanderminden | 135/20.3 |

*Primary Examiner*—John M. Jillions
*Attorney, Agent, or Firm*—W. Wayne Liauh

[57] ABSTRACT

An improved winding device is provided for large scale umbrellas which is disposed at suitable position of the supporting metal rod of the umbrella. A cable is attached to the winding device such that by the winding and unwinding of the cable using the winding device, a runner can be moved up or down such that the stretchers and the associated panel can be extended or retracted. The winding device includes a housing having a hollow configuration, a crankshaft and a winding reel. The metal rod is provided with a shaft hole and the housing is enclosed around to the shaft hole. One side of the housing is provided with openings for receiving a crank handle and a winding reel. The winding device also includes a teethed and spring structure inside the housing which cooperatively exert a braking force on the rotation of the crankshaft, but the force can be overcome to allow movements of the crankshaft in both directions of rotation under force from the crank handle.

3 Claims, 4 Drawing Sheets

COIL WINDER FOR USE IN LARGE UMBRELLAS

This application claims benefit of Provisional Appl. No. 60/037,440, filed Feb. 7, 1997.

FIELD OF THE INVENTION

The present invention relates to a winding device, more particularly, to an improved winding device for umbrellas of the type which are large and widely used in gardens and beaches. A teeth and spring plate are provided such that the winding and unwinding of the cable disposed within the metal rod can be accurately controlled. As a result, the runner can be accurately positioned. Furthermore, a clear click sound can also be heard during the manipulation.

DESCRIPTION OF PRIOR ART

For umbrellas of the type which are used in gardens and beaches, a winding device is disposed on the metal rod to move up and down along the runner via a cable connected therebetween. By the up and down running of the runner, the stretchers and panels attached thereto can be extended and retracted.

However, by the limitation of the conventional design, the manipulation of the conventional winding device has several problems. For example, the umbrella used on garden and beach has a winding device with a large diameter which is connected to the runner. Nevertheless, the winding device is not provided with a braking device to position the runner in a suitable position. During the winding up of the cable, the winding process may stop while the panels are not completely opened. If the winding device is not provided with a braking device, the retracting of the panels will force the crank handle to rotate counterclockwise. This is quite dangerous to the user because the user can be injured by the uncontrolled rotation of the crank handle.

Furthermore, in the conventional umbrella, the runner can only be stopped by the top spring disposed at top of the metal rod as the runner runs to a certain position. However, during the running step, the is no braking device provided to stop the runner. The user cannot get a tactile feeling during the manipulation of the umbrella. Accordingly, the stretching of the umbrella is similar to the ordinary umbrella.

SUMMARY OF THE INVENTION

It is an objective of the present invention to provide an improved winding device for umbrella wherein a teethed structure having a crankshaft is provided with a spring plate such that the teeth can be readily positioned during the winding and unwinding of the cable wound on the teeth. Besides, a clear click sound can be also heard during the winding the unwinding of the cable.

It is another objective of the present invention to provide an improved winding device for umbrella which features a single and compact configuration. With the cooperation of the teeth and the spring plate, the runner, which is driven by the cable attached thereof, can be readily positioned to a certain position during the up-running or down-running stroke. With this arrangement, the risk encountered by conventional art can be avoided.

It is yet another objective of the present invention to provide a winding device for an umbrella wherein by the cooperation of the teeth and the spring plate, a clear click sound can be heard and the palm of the user can have a clear feel of the winding action during the rotation of the crankshaft.

It is still another object of the present invention to provide a winding device for an umbrella wherein the number of elements used is reduced and it is specially suitable for umbrellas of a large scale, such as those used in garden and beach.

BRIEF DESCRIPTION OF DRAWINGS

In order that the present invention may more readily be understood the following description is given, merely by way of example with reference to the accompanying drawings, in which.

BRIEF DESCRIPTION OF NUMERALS

| | |
|---|---|
| 10 winding device | 11 metal rod |
| 12 shaft hole | 13 housing |
| 14 clipping element | 15 bolt members |
| 16 crank handle | 17 crankshaft |
| 18 teeth | 19 winding reel |
| 20 cable | 21 spring plate |
| 22 opening | 23 nut |
| 24 stopping block | |

DETAILED DESCRIPTION OF PREFERRED EMBODIMENT

Figure 1:
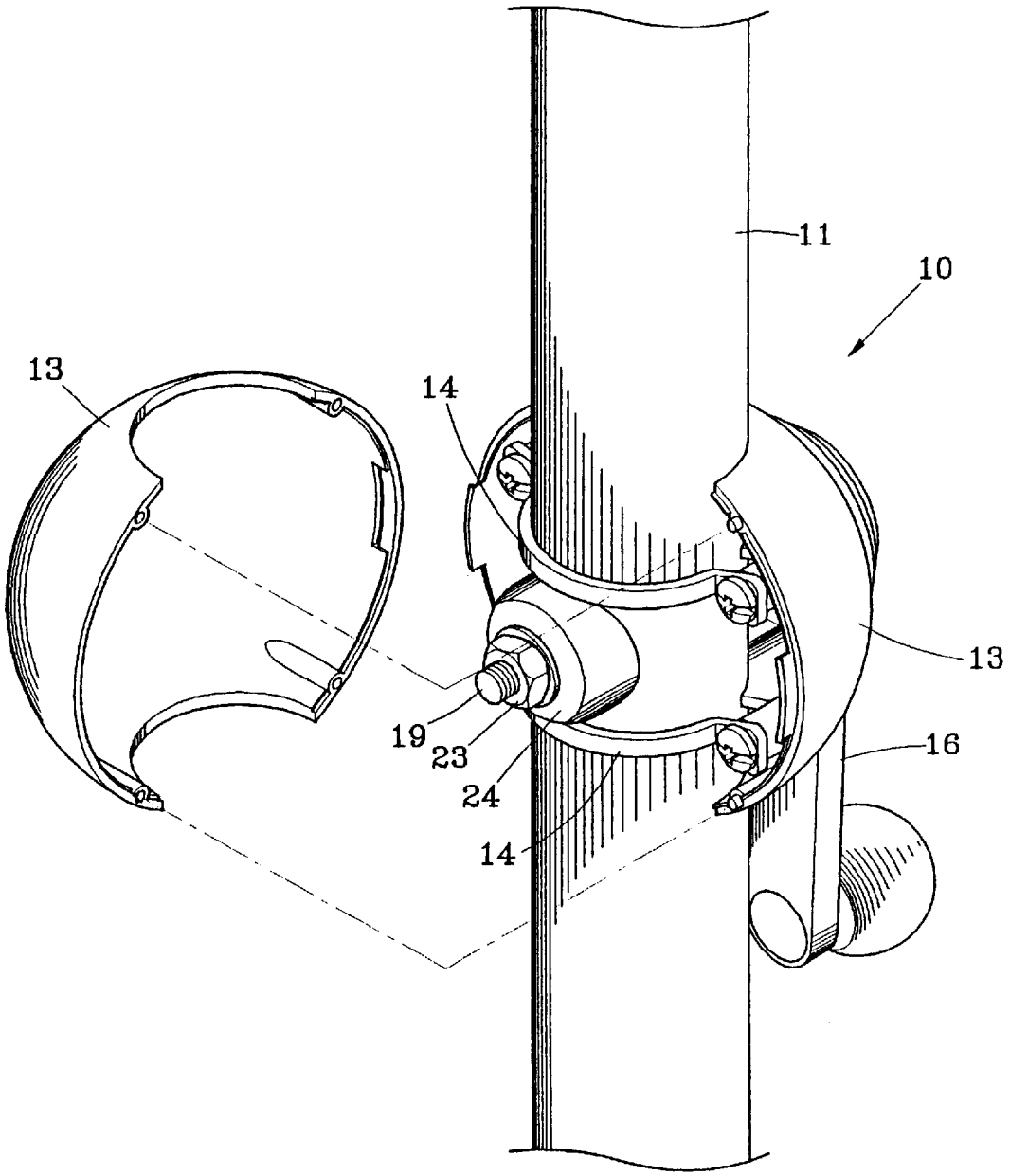
FIG. 1 is a perspective view of the present invention wherein parts of the covering have been removed thereof.
Figure 2:
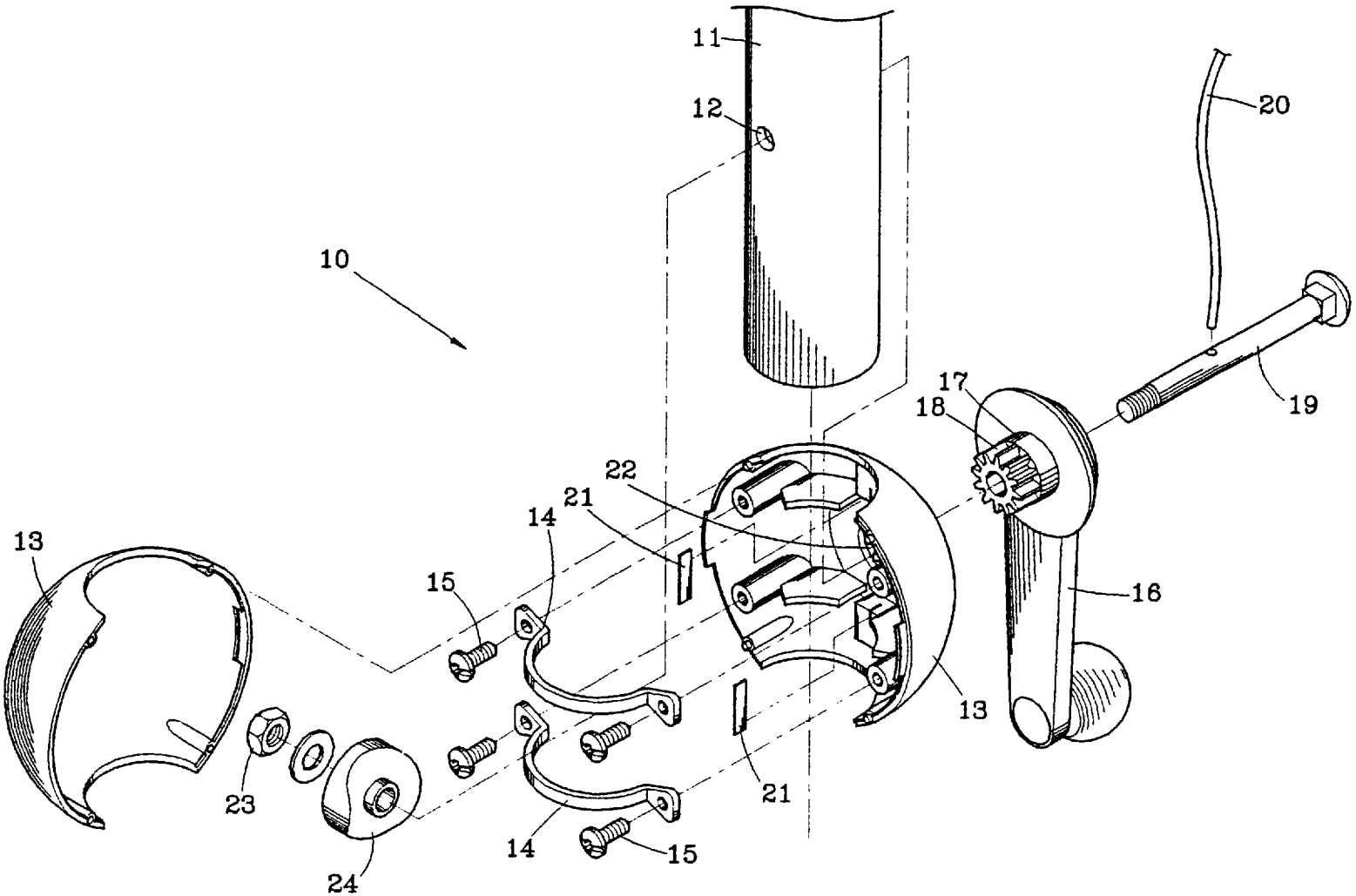
FIG. 2 is an exploded perspective of the coil winder made according to the present invention.

Referring to FIGS. 1 and 2, the improved winding device 10 is disposed at a suitable position of the metal rod 11 of the large scale umbrella. A cable 20 is attached to the winding deice 10 such that by the winding and unwinding of the cable 20 with the winding device 10, the runner can be moved such that the stretchers and associated panels can be extended or retracted. The winding device 10 generally comprises a housing 13 having a hollow configuration, a crankshaft 16 and winding reel 19.

Figure 3:
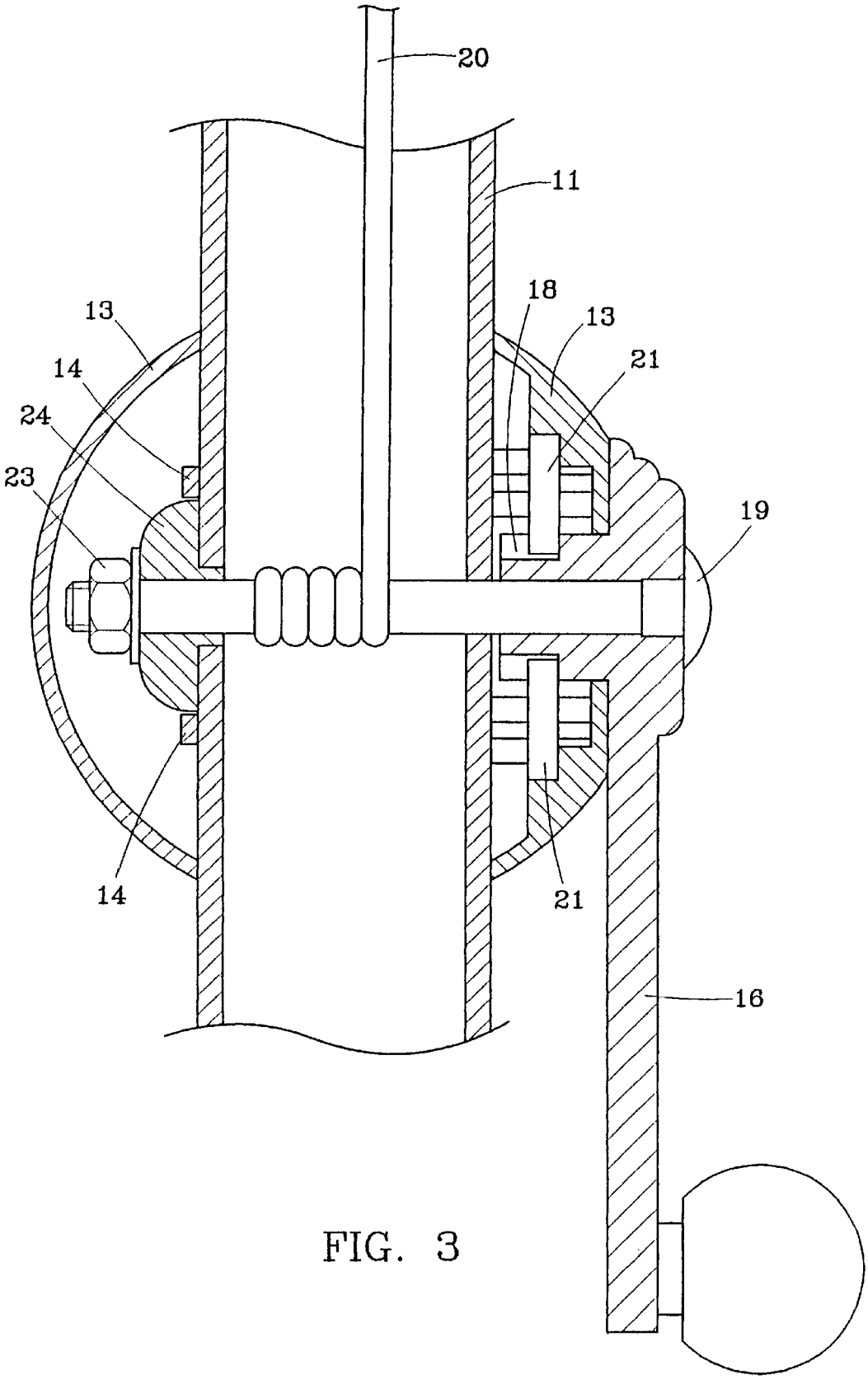
FIG. 3 is a cross sectional view taken along the longitudinal direction.
Figure 4:
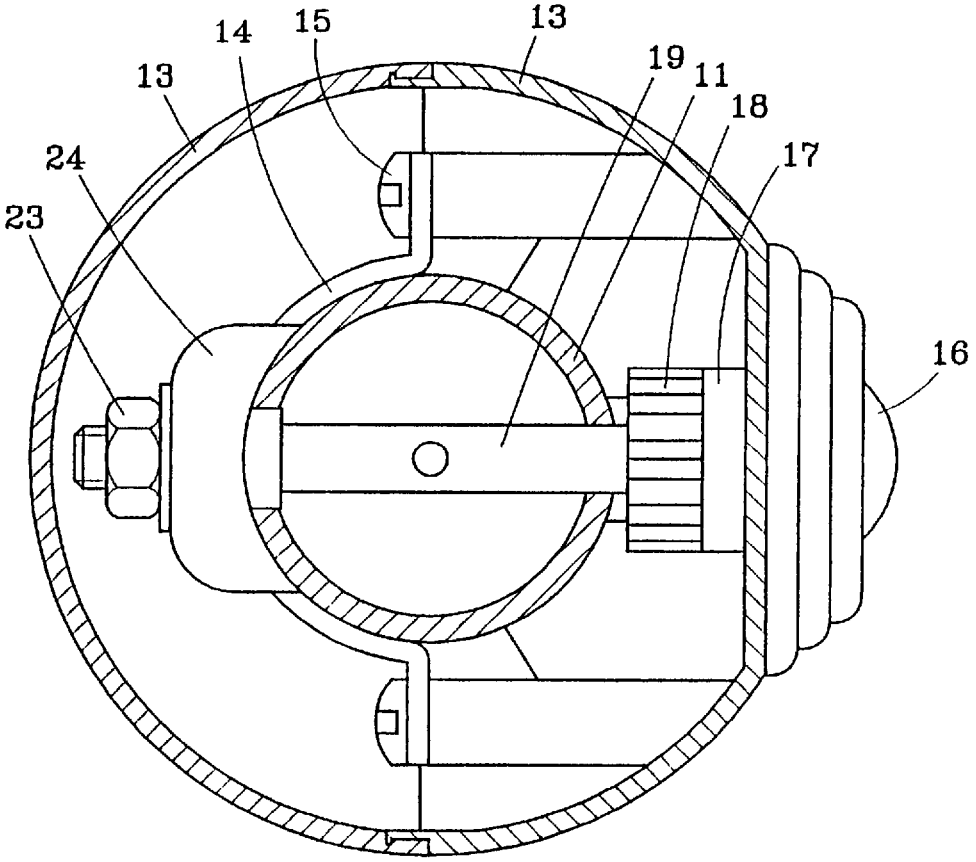
FIG. 4 is still a cross sectional view taken from traverse direction.

As shown in FIGS. 1 and 2, the housing 13 is configured to include a pair of circular halves 14 each having a plurality of bolt members 15 thereof. The metal rod 11 is provided with a shaft hole 12 and those two halves 14 are enclosed around to the shaft hole 12. One side of the housing 13 is provided with an opening 22 for receiving the crank handle 16 and the winding reel 19. After the crank handle 16 and the winding reel 19 are installed, the cable 20 disposed within the metal rod 11 can be wound onto the winding reel 19, as shown in FIG. 3. By this arrangement, when the crank handle 16 is rotated, the winding reel 19 is actuated to wind or unwind the cable 20.

The crank handle 16 is disposed within the opening 22 of the housing 13 by means of a crankshaft 17. In the front position of the crankshaft 17, a teethed structure 18 is disposed coaxially.

The winding reel 19 can be disposed onto the crankshaft 17. When the crankshaft 17 is rotated, the winding reel 19 is rotated accordingly.

The winding reel 19 is disposed traverse to the metal rod 11 such that the cable 20 can be wound onto the winding reel 19. In the distant end of the winding reel 19, a nut 23 and a stopping block 24 are utilized to position the winding reel 19.

As shown in FIGS. 2 and 3, within the opening 22 of the housing 13, a spring plate 21 is disposed with respect to the teethed structure 18 of the crank handle 16. In the preferred embodiment shown in FIGS. 2 and 3, the spring plate 21 is disposed below the teethed structure 18. One end of the spring plate 21 is anchored on the housing 13 and the other end of the spring plate 21 is seated within the valley of the teethed structure 18.

By this arrangement, when the crank handle 16 is rotated to wind or unwind the cable 20, the rotation of the crank handle 16 can be readily stopped by the cooperation of the teethed structure 18 and the spring plate 21. Once the cable 20 is stopped, the runner which is connected to the cable 20 is also stopped accordingly. In light of this, the runner of the umbrella can be stopped and positioned at any position along the metal rod 11 as the teethed structure 18 is blocked by the spring plate 21. In light of this by the provision of the teethed structure 18 and the spring plate 21, the crank handle 16 can be stopped in a controlled manner without rotating continuously. The risk resulted therefrom is therefore reduced. Besides, during the rotation of the teethed structure 18, a clear click sound can be heard by the cooperation of the teethed structure 18 and the spring plate 21.

In manufacturing, the spring plate 21 can be incorporated with one or more than one teethed structure 18. In the preferred embodiment, the teethed structure 18 is incorporated with a pair of spring plates 21. Furthermore, the installing position of the teethed structure 18 and the spring plate 21 can be interchanged with each other, i.e. the teethed structure 18 can be disposed within the opening 22 of the housing 13 and the spring plate 21 can be disposed on the crankshaft 17.

As described above, by the provision of the teethed structure and the spring plate, the winding and unwinding of the cable performed by the rotation of the crank handle can be accurately controlled. Besides, a clear click sound can be also heard during the winding and unwinding. The problem encountered by the conventional art can be completely solved. Furthermore, the runner connected to one end of the cable can be also suitable stopped during the winding and unwinding process. By this arrangement, the risk resulted from losing control of the crank handle can be completely solved. Besides, the provision of the click sound can also upgrade the quality of the product and the winding device features with a compact and single configuration wherein the number of the elements is reduced.

While particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

What is claimed is:

1. A winding device for using in umbrellas, comprising:

a housing affixed to a support rod of the umbrella, said housing having an opening;

a crank handle affixed to said housing a crank shaft, which fits into said opening of said housing;

a winding reel disposed outside of said housing and axially connected to said crankshaft such that when said crankshaft rotates, said winding reel also rotates;

a teethed structure axially connected to said crankshaft such that when said crankshaft rotates, said teethed structure also rotates, said teethed structure having a plurality of teeth respectively separated by a plurality of valleys;

a spring plate with one end fixed to said housing and other end penetrating into said valley wherein said spring plate and said teethed structure are cooperating to exert a braking force to said crankshaft but also to allow movements of said crankshaft in both directions of rotation under force from said crank handle.

2. An improved winding device for umbrella as recited in claim 1, wherein said spring plate is disposed at said opening of said housing with respect to said teethed structure disposed at the crank shaft.

3. An improved winding device for umbrella as recited in claim 1, wherein a plurality of spring plates are disposed with respect to the teethed structure.

* * * * *